US009322216B2

(12) United States Patent
Chan et al.

(10) Patent No.: US 9,322,216 B2
(45) Date of Patent: Apr. 26, 2016

(54) ANNULUS RING HOLE DRILL

(75) Inventors: Leung Choi Chan, Hong Kong (HK); Kin Choi Chan, Hong Kong (HK)

(73) Assignee: TOP MARK MECHANICAL EQUIPMENT LIMITED, Hong Kong (HK)

( * ) Notice: Subject to any disclaimer, the term of this patent is extended or adjusted under 35 U.S.C. 154(b) by 285 days.

(21) Appl. No.: 13/884,270

(22) PCT Filed: Feb. 10, 2012

(86) PCT No.: PCT/CN2012/071040

§ 371 (c)(1),
(2), (4) Date: May 9, 2013

(87) PCT Pub. No.: WO2012/106999

PCT Pub. Date: Aug. 16, 2012

(65) Prior Publication Data

US 2013/0306379 A1 Nov. 21, 2013

Related U.S. Application Data

(60) Provisional application No. 61/441,656, filed on Feb. 11, 2011.

(51) Int. Cl.

| | |
|---|---|
| ***E21B 4/10*** | (2006.01) |
| ***E21B 4/14*** | (2006.01) |
| ***E21B 10/36*** | (2006.01) |

(52) U.S. Cl.

CPC ... *E21B 4/10* (2013.01); *E21B 4/14* (2013.01); *E21B 10/36* (2013.01)

(58) Field of Classification Search

CPC ..... E21B 10/02; E21B 4/10; E21B 4/14; E21B 10/36

See application file for complete search history.

(56) References Cited

U.S. PATENT DOCUMENTS

| | | | |
|---|---|---|---|
| 3,299,971 | A | 1/1967 | Lewis |
| 3,982,596 | A | 9/1976 | Vetter |

(Continued)

FOREIGN PATENT DOCUMENTS

| | | | |
|---|---|---|---|
| CN | 2175037 | Y | 8/1994 |
| CN | 1102867 | A | 5/1995 |

(Continued)

OTHER PUBLICATIONS

Office Action issued from State Intellectual Property Office of the P.R.C on Apr. 14, 2014.

(Continued)

*Primary Examiner* — Brad Harcourt

(74) *Attorney, Agent, or Firm* — Ella Cheong Hong Kong; Sam T. Yip

(57) ABSTRACT

An apparatus for drilling annulus ring hole, comprising: a down-the-hole (DTH) percussion hammer assembly, the DTH percussion hammer assembly comprising one or more DTH percussion hammers, an annulus ring structural housing having an outer diameter (OD) and an inner diameter (ID) for accommodating the DTH percussion hammers within space between the OD and the ID of the annulus ring structural housing; one or more drill pipes being connected serially with each other forming a string of drill pipes, the string of serially connected drill pipes being connected to the DTH percussion hammer assembly; a top pipe with one or more exhaust openings being connected to the string of serially connected drill pipes; an air or fluid distributor being connected to the top pipe; and a rotary head providing rotational turning motion for the apparatus, and the rotary head being connected to the air distributor.

8 Claims, 6 Drawing Sheets

(56) References Cited

U.S. PATENT DOCUMENTS

| | | | | |
|---|---|---|---|---|
| 4,321,974 | A | 3/1982 | Klemm | |
| 4,705,119 | A | 11/1987 | Kostylev et al. | |
| 4,709,768 | A | 12/1987 | Kostylev et al. | |
| 4,771,835 | A | 9/1988 | Eaton | |
| 4,819,746 | A | 4/1989 | Brown | |
| 5,267,622 | A * | 12/1993 | Fletcher et al. | 175/296 |
| 6,145,601 | A | 11/2000 | Mocivnik et al. | |
| 6,189,630 | B1 * | 2/2001 | Beck, III | 175/96 |
| 2001/0006120 | A1 * | 7/2001 | Miyamoto et al. | 175/61 |
| 2014/0011565 | A1 | 1/2014 | Elias et al. | |

FOREIGN PATENT DOCUMENTS

| | | | |
|---|---|---|---|
| CN | 201027489 | Y | 2/2008 |
| CN | 101949261 | A | 1/2011 |
| CN | 101956525 | A | 1/2011 |
| FR | 2623242 | A1 | 5/1989 |
| SU | 00276869 | A1 | 8/1970 |
| UA | 6742 | U | 12/1994 |
| WO | 9423172 | A1 | 10/1994 |
| WO | 2005010317 | A1 | 2/2005 |
| WO | 2010071563 | A1 | 6/2010 |

OTHER PUBLICATIONS

Patent Examination Report issued from Australian Government IP Australia of Australia on Sep. 9, 2014.

Yesin N.N et al., Pneumatic percussion machines for holes and bores drilling, Novosibirsk: Science 1986, p. 52.

Patent Examination Report issued from Russian Government IP Russian of Russian on Nov. 21, 2014.

Office Action issued from State Intellectual Property Office of the P.R.C on Oct. 15, 2014.

* cited by examiner

ANNULUS RING HOLE DRILL

FIELD OF THE INVENTION

The present invention relates generally to civil building construction. More specifically, the present invention relates to techniques and equipments used in building structural foundation piling.

BACKGROUND

Conventional ground drilling equipments or techniques normally drill holes with a single or outer diameter (OD) target. Depending on the ground condition, a casing sometimes is inserted in the ground to prevent collapse of soil when the ground condition is loose. In the case where the ground strata are stable, no casing is necessary. In either case, all the materials inside the hole will needed to be excavated away in the process of drilling.

One design of drilling equipment has a single down-the-hole (DTH) percussion hammer. With this design, the hole drilled has a maximum possible size of about 1500 mm in diameter. Such single DTH hammer drilling will result in complete excavation of all materials inside the hole drilled as well.

Another design of drilling equipment has a number of DTH percussion hammers arranged over a circular disc and housed inside a circular housing. Because all the materials of the circular hole drilled will be fully excavated, this design is limited only to drilling solid circular holes, not annulus ring shaped holes.

It is also common to use a rotary drilling machine to drill holes with auger in relatively soft ground or core barrel in harder ground condition. This kind of drilling method will also entail the excavation of all materials inside the hole leaving only a solid circular hole.

There is also another drilling technique that utilizes a casing oscillator to first drive a casing down into the ground by oscillation and pushing. In order to continue driving the casing down into the ground, it is necessary to excavate the materials inside the cased hole during the drive by tools such as hammer grabs and chisels. As such, this drilling technique cannot be used to form annulus ring hole. The penetration speed is also very low.

SUMMARY

It is an objective of the presently claimed invention to provide an apparatus for drilling an annulus ring hole in the ground. That is, by using a drilling apparatus with a number of down-the-hole (DTH) percussion hammers driven by compressed air or pressurized fluid, such as water, arranged and allocated in an annulus housing, to drill an annulus ring shaped hole in the ground with different outer diameters (OD) and inner diameters (ID), which can be designed to match certain requirements of a drilling or a building structural foundation piling project. The OD of the annulus ring hole typically can range from 200 mm to 5000 mm (or larger). To meet the various OD and ID configurations requirement, the number of DTH hammers and their distribution positions over the drilling area are configurable.

The presently claimed invention provides an apparatus for drilling an annulus ring hole without excavating or disturbing the ground material in the central interior area of the annulus ring hole. Only the materials inside the annulus ring area being excavated leaving a column of materials in the central interior area (the circular area within the ID) of the annulus ring hole. The high percussive power of the apparatus allows penetration of hard rock ground material such as granite with reasonable speed.

BRIEF DESCRIPTION OF THE DRAWINGS

Embodiments of the invention are described in more detail hereinafter with reference to the drawings, in which.

DETAILED DESCRIPTION

In the following description, apparatus for annulus ring hole drilling and the like are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation. Although the embodiments described in the following pertain to using compressed air as the force delivery medium, pressurized fluid, such as water, can be used in place of compressed air without substantial modification to the presently claimed invention.

Figure 1:
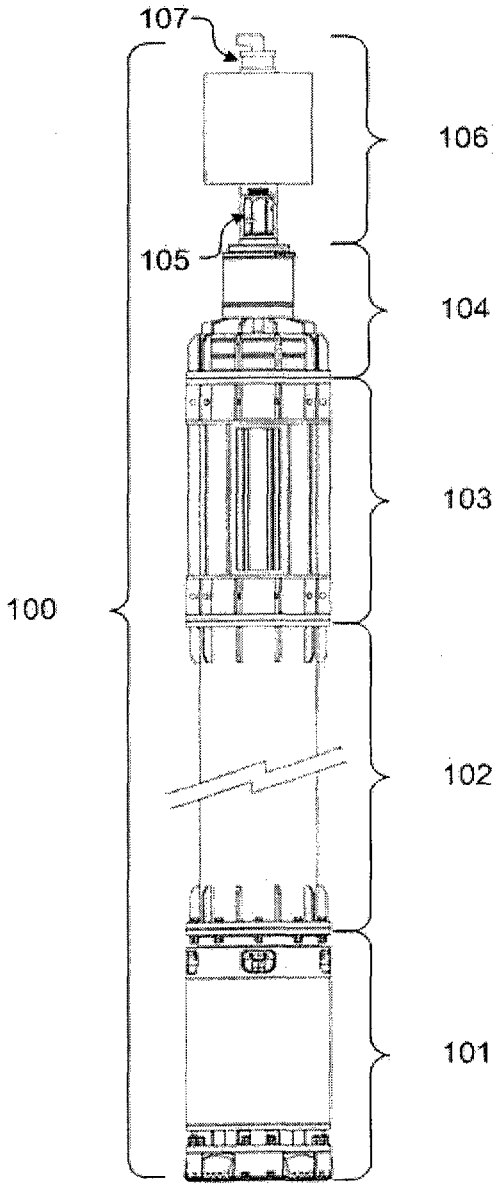
FIG. 1 shows the side view of one embodiment of the presently claimed annulus ring hole drilling apparatus.

Referring to FIG. 1. The side view of an annulus ring hole drill string 100 is shown in FIG. 1. In accordance with various embodiments, the annulus ring hole drill string includes a DTH percussion hammer assembly 101, one or more drill pipe 102, a top pipe with exhaust openings 103, an air distributor 104, a rotary head connection interface 105 for connecting a rotary head 106. The rotary head 106 provides rotational turning speed and output torque for the entire drill string 100. Rotary head 106 is equipped with intake swivel 107 where compressed air is supplied from an external source and delivered through an internal channel down to the rotary head connection interface 105. Other configurations of drill pipe, top pipe, and air distributor can be adopted. The number and total length of drill pipes 102 adopted depend on the required drilling depth of the annulus ring hole to be drilled. In some cases of shallow drilling, no drill pipe is necessary.

Compressed air supplied from the external source to the intake swivel 107 is delivered through the internal channel in the rotary head 106 and down to the rotary head connection interface 105 and through the internal channel in the rotary head connection interface 105 to the air distributor 104 below it. The air distributor 104 diverts the airflow into a number of separate air paths matching the number of DTH percussion hammers employed in the DTH percussion hammer assembly 101. In this exemplary embodiment, five DTH percussion hammers are employed. In this case, the air distributor 104 ends with five air passages; each is further connected to an internal air-delivery pipe in the top pipe with exhaust openings 103, to an internal air-delivery pipe in the drill pipe 102, then to the respective DTH percussion hammer.

Still referring to FIG. 1. During drilling, while the DTH percussion hammers are impacting the ground, the entire drill string, including the air distributor 104, the drill pipes 102, and the front annulus ring drilling percussion hammer assembly 101, is rotating, driven from the top by the rotary head. The rotary head provides the necessary turning torque for overcoming the drilling friction. The rotation axis is the centre of the annulus ring. Therefore, the percussion and impacting actions provided by each drill bit combined with the continuous turning of the annulus ring drilling percussion hammers result in the complete smashing of the ground materials within the targeted annulus ring drilling area.

Figure 5:
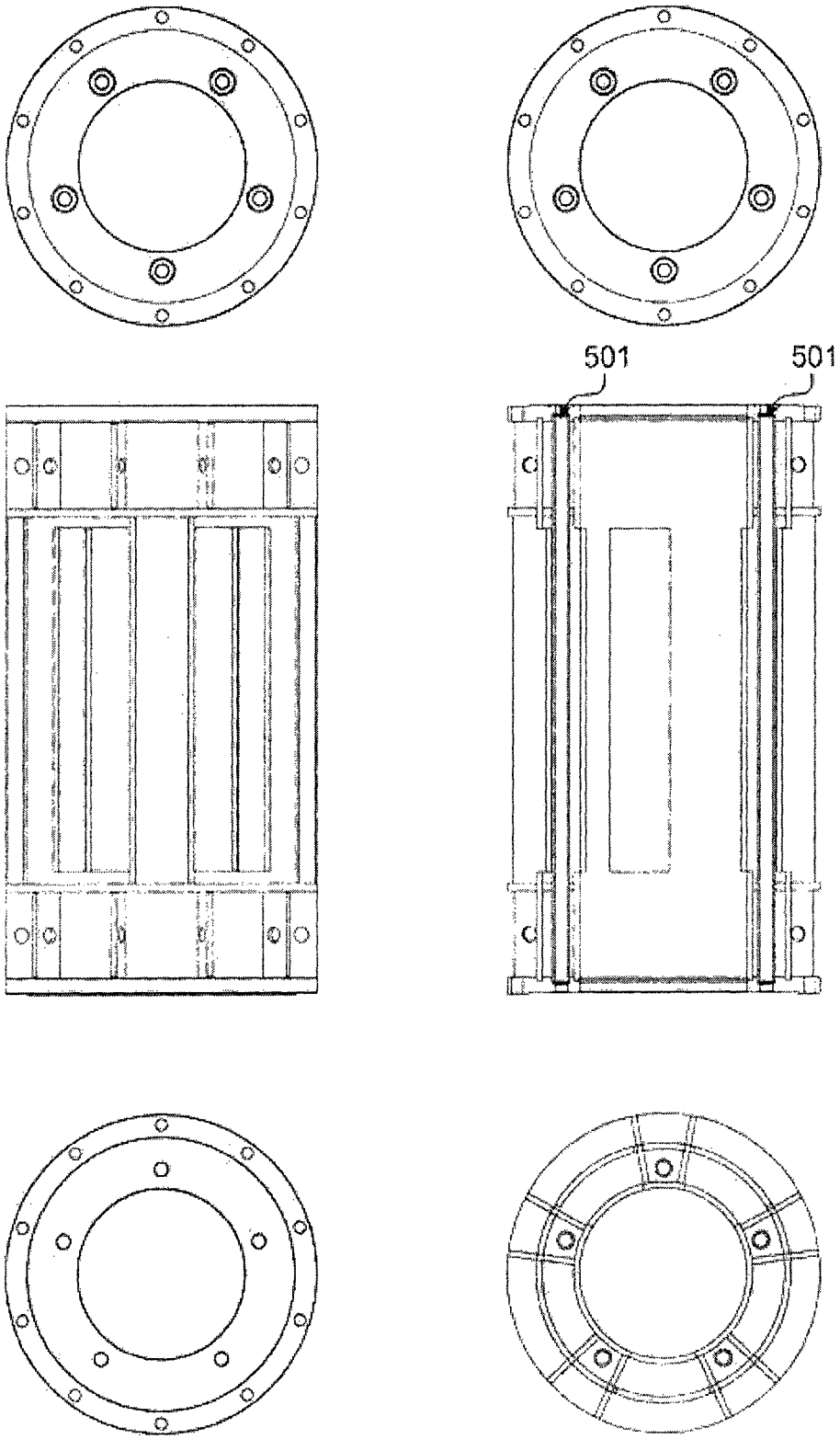
FIG. 5 shows the top pipe with exhaust openings of one embodiment of the presently claimed annulus ring hole drilling apparatus.

Referring to FIGS. 1 and 5. As shown in FIG. 5, internal air-delivery pipes 501 are equipped from top end to bottom end of the top pipe with exhaust openings 103, where it is further connected to the drill pipes 102 below. Compressed air is delivered through the internal air-delivery pipes 501 in the top pipe with exhaust openings 103, the internal air-delivery pipes in the drill pipes 102, then reaches the top connection interface of the DTH percussion hammer assembly 101. At the top connection interface, the compressed air delivered from the internal air-delivery pipes in the drill pipes 102 is supplied to a receiving port at the top of back head of the DTH percussion hammer assembly 101.

Figure 4:
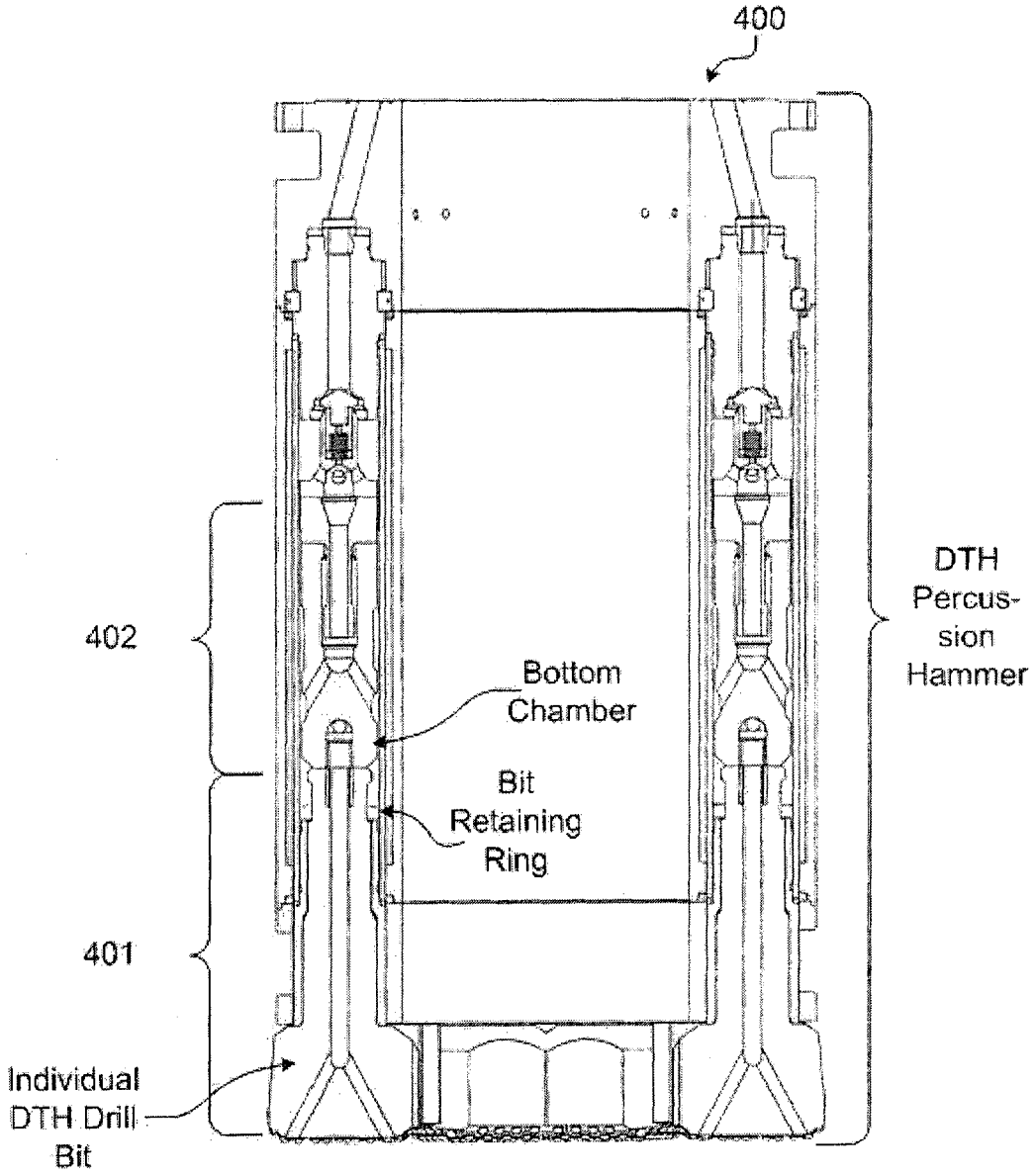
FIG. 4 shows the cross sectional view of the DTH percussion hammer assembly of one embodiment of the presently claimed annulus ring hole drilling apparatus.

Referring to FIGS. 1 and 4. The back head is an annulus housing with a prescribed OD and ID. In the back head, the compressed air is directed through an air channel and presses the top adaptor of the DTH percussion hammer, driving the reciprocal hammering action of the piston 402. The piston 402 strikes on the drill bit 401 below transferring the hammering force, and in turn the drill bit impacts the ground. After each strike, the compressed air passes through the piston and is released out of the exhaust outlet located at the bottom of the drill bit. The exhausted compressed air simultaneously flushes away broken debris or rock particles, conveying them along both the inner and outer surfaces of the annulus ring structural housing 400. The broken debris and rock particles that are flushed along the outer surface of the annulus ring structural housing 400 travel upwards along the drill pipes 102 and escape out on to the ground surface. Whereas those that are flushed along the inner surface of the annulus ring structural housing 400 travel upwards along the drill pipes 102, reach the top pipe with exhaust openings 103, and escape through the exhaust openings out on to the ground surface.

Tie bolts are used to tie together the DTH percussion hammer assembly 101's front section, main body, and the back head with nuts and lock nuts. When servicing the individual DTH hammer or changing the drill bits, the tie bolts can be loosened or removed. Other known methods of tying together the main elements of the annulus ring hole drilling percussion hammer assembly 101 should be apparent to practitioners skilled in the art.

The top adaptors of the DTH percussion hammers are located and housed in the back head at prescribed position and are screwed together with their corresponding DTH percussion hammer body. The top adaptor is supported and retained in the back head housing by a pair of bit retaining rings. The chuck of each DTH percussion hammer is mounted at its bottom and is of hexagonal outer sectional shape. The hexagonal chucks are located in place and housed in the front section of the DTH percussion hammer assembly 101. The hexagonal chucks have the advantage of enabling their corresponding hexagonal housing to withhold any torsion load experienced by the individual DTH percussion hammer along its own longitudinal axis during drilling. It is, however, possible to use chucks of other shapes such as circular sectional chucks.

The drilling OD of the annulus ring hole is determined by the radius distance from the exterior gauge dimension of the specially sized drill bit to the centre of the annulus ring drilling structural housing 400. The drilling ID of the annulus ring hole is determined by the radius distance from the interior gauge dimension of the specially sized drill bit to and the centre of the annulus ring structural housing 400.

The drilling OD of the annulus ring hole is designed to be larger than the OD of the annulus ring DTH percussion hammer assembly 101 and the drill pipes 102. That is, the exterior gauge of the drill bit 401 is protruded away from the OD of the annulus ring structural housing 400. The drilling ID of the annulus ring hole, on the other hand, is designed to be smaller than the ID of the annulus ring DTH percussion hammer assembly 101 and the drill pipes 102. That is, the interior gauge of the drill bit 401 is protruded away from the ID of the annulus ring structural housing 400. The purpose of this arrangement is to reduce the drag resistance on the surface of the entire drill string as it advances deeper and deeper into the ground.

Figure 2:
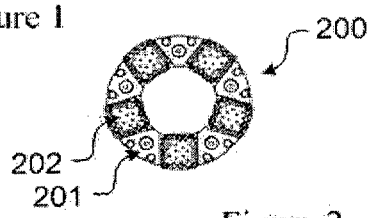
FIG. 2 shows the bottom view of the DTH percussion hammer assembly one embodiment of the presently claimed annulus ring hole drilling apparatus.
Figure 3:
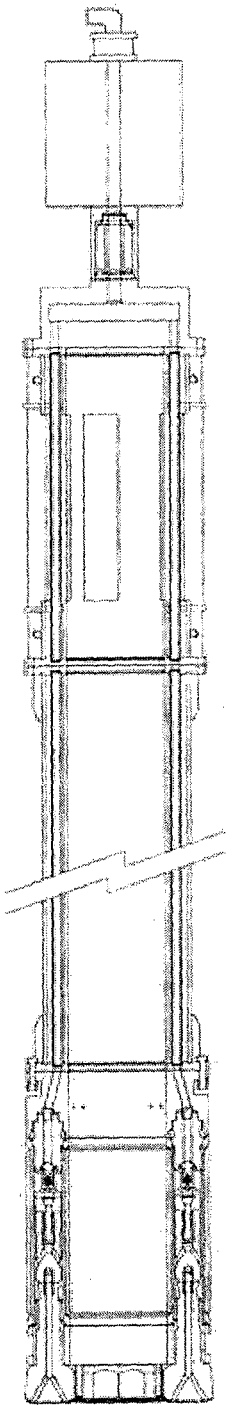
FIG. 3 shows the cross sectional view of one embodiment of the presently claimed annulus ring hole drilling apparatus.
Figure 7:
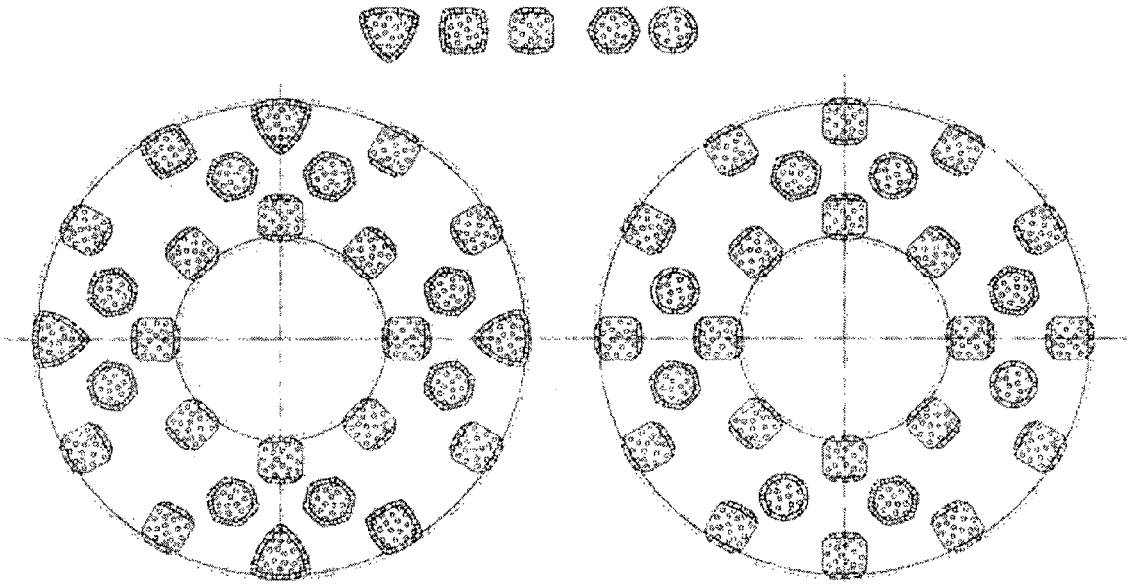
FIG. 7 shows various exemplary drill bit cutting face profiles and various exemplary drill bit arrangements of more than one circumferential layers of drill bits.

Depending on the requirement of the annulus ring hole, various allocation arrangements of the drill bits are possible. If the difference between the annulus ring hole OD and ID is small, one circumferential layer of drill bits is used. In one embodiment, one circumferential layer comprises five drill bits, which is shown in FIG. 2. For annulus ring holes with a large OD-ID difference, two to three circumferential layers of drill bits can be used to cover the large annulus ring drilling area as shown in FIG. 7.

The front annulus ring percussion hammer assembly 101 shown in FIG. 1 includes five air driven DTH percussion hammers distributed and assembled over an annulus ring structural housing 400. The structural housing 400 has a prescribed housing OD and a prescribed housing ID. The surfaces created by the housing OD and housing ID function as the flushing surfaces for exhaust air and drilling debris. The space between the housing OD and ID accommodates the DTH percussion hammers of which the number and size are determined by the required annulus ring hole OD and ID. Each DTH percussion hammer is assembled longitudinally inside this housing space in parallel with the drilling axis of the drill string. All DTH percussion hammers are held and supported by the housing along its longitudinal direction.

Referring to FIG. 2. Each drill bit 202 is fixed in its position by its two adjacent index blocks 201. The index blocks 201 prevent the drill bits 202 from self-turning along the axis of its corresponding DTH percussion hammer. The index blocks 201 are specifically built to withstand the torque and thrust forces experienced by the drill bits 202 during the drilling process with the annulus ring drilling percussion hammer assembly rotating and each drill bit 202 impacting the ground. The indexing of each drill bit 202 also restricts it from self-turning so as to allow maximum possible ground impacting area on both the exterior protruding gauge and the interior protruding gauge at all time during drilling.

Figure 6:
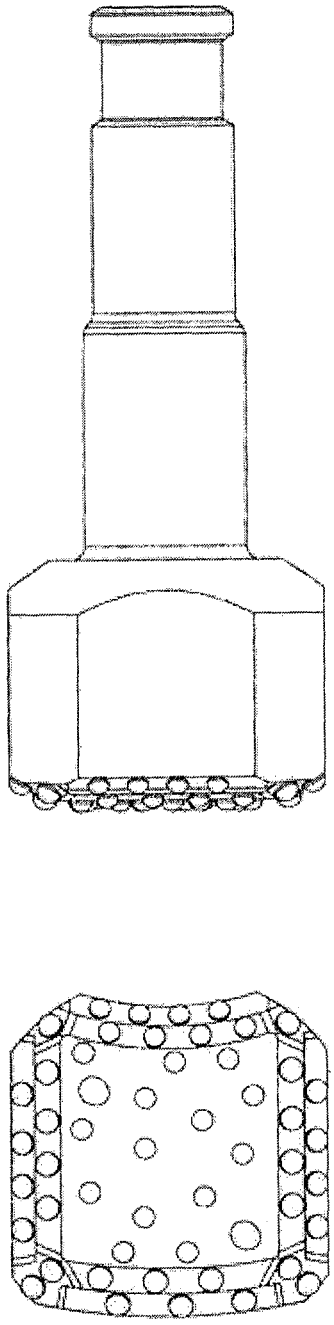
FIG. 6 shows the drill bit of one embodiment of the presently claimed annulus ring hole drilling apparatus.

Referring to FIG. 6. In accordance with various embodiments, specially designed percussion drill bits with tungsten carbide tips 601 are mounted at the bottom of each drill bit. The drill bit has a special peripheral profile to achieve a larger percussion area on both the annulus OD and ID drilling areas. The drill bit cutting face profile is not necessary circular in shape, and can be triangular, rectangular, or any special profiled shape as shown in FIG. 7. The drill bit cutting face profile is designed to achieve maximum material smashing are on both the exterior protruding gauge and the interior protruding gauge.

In accordance with various embodiments, pressurized fluid instead of compressed air can be used to drive the reciprocal hammering actions of the DTH percussion hammers. In this case, pressurized fluid, instead of compressed air, is supplied through the intake swivel 107 in the rotary head 106, delivered through fluid-delivery pipes in the top pipe 103 and the drill pipes 102 to each of the DTH percussion hammers driving reciprocal hammering action during drilling.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. An apparatus for drilling annulus ring hole, comprising:

a down-the-hole (DTH) percussion hammer assembly, the DTH percussion hammer assembly comprising one or more DTH percussion hammers, an annulus ring structural housing having an outer diameter (OD) and an inner diameter (ID) for accommodating the DTH percussion hammers within space between the OD and the ID of the annulus ring structural housing;

a top pipe with one ore more exhaust openings, the top pipe being connected to the DTH percussion hammer assembly;

one or more drill pipes, the drill pipes being attached vertically with each other forming a string of drill pipes, the string of drill pipes being connected at a first end to the DTH percussion hammer assembly, and the string of drill pipes being connected at a second end to the top pipe;

an air or fluid distributor, the air or fluid distributor being connected to the top pipe; and a rotary head, the rotary head providing rotational turning motion for the apparatus, and the rotary head being connected to the air or fluid distributor;

wherein each of the DTH percussion hammer comprises a drill bit;

wherein the drill bit having an exhaust outlet located at the bottom of the drill bit for releasing compressed air or pressurized fluid;

wherein the exhausted compressed air or pressurized fluid simultaneously flushes away broken debris or rock particles, conveying them along both inner and outer surfaces of the annulus ring structural housing;

wherein the broken debris and rock particles that are flushed along the outer surface of the annulus ring structural housing travel upwards along the drill pipes and escape out on to ground surface; and wherein the broken debris and rock particles that are flushed along the inner surface of the annulus ring structural housing travel upwards along the drill pipes, reach the top pipe, and escape through the exhaust openings out on to the ground surface.

2. The apparatus of claim 1, wherein the drill bit being fixed in its position within the annulus ring structural housing by two adjacent index blocks, preventing the drill bit from self-turning along the axis of its corresponding DTH percussion hammer, wherein the adjacent index blocks are specifically built to withstand torque and thrust forces experienced by the drill bit during drilling process; and a piston on top of the drill bit for delivering hammering forces during drilling.

3. The apparatus of claim 1, wherein the drill bit having an exterior gauge that is protruded away from OD of the annulus ring structural housing, and an interior gauge that is protruded away from ID of the annulus ring structural housing, such that OD of the annulus ring hole is larger than OD of the DTH percussion hammer assembly and the drill pipes, and that ID of the annulus ring hole is smaller than ID of the DTH percussion hammer assembly and the drill pipes.

4. The apparatus of claim 1, wherein the drill bit having tungsten carbide tips mounted at the bottom of the drill bit.

5. The apparatus of claim 1, wherein the DTH percussion hammers are arranged into one circumferential layer within the space between the OD and the ID of the annulus ring structural housing.

6. The apparatus of claim 1, wherein the DTH percussion hammers are arranged into two or more circumferential layers within the space between the OD and the ID of the annulus ring structural housing.

7. The apparatus of claim 1, wherein compressed air is supplied through an intake swivel in the rotary head, delivered through one or more internal air-delivery pipes to each of the DTH percussion hammers driving reciprocal hammering action during drilling.

8. The apparatus of claim 1, wherein pressurized fluid is supplied through an intake swivel in the rotary head, delivered through one or more internal fluid-delivery pipes to each of the DTH percussion hammers driving reciprocal hammering action during drilling.

* * * * *